US007980958B1

(12) United States Patent
Ford

(10) Patent No.: US 7,980,958 B1
(45) Date of Patent: Jul. 19, 2011

(54) GOLF WORK STATION

(76) Inventor: David D. Ford, Hanover, MA (US)

( * ) Notice: Subject to any disclaimer, the term of this patent is extended or adjusted under 35 U.S.C. 154(b) by 0 days.

(21) Appl. No.: 12/804,285

(22) Filed: Jul. 19, 2010

Related U.S. Application Data

(63) Continuation-in-part of application No. 12/321,206, filed on Jan. 16, 2009, now Pat. No. 7,758,443.

(51) Int. Cl.
*A63B 69/36* (2006.01)

(52) U.S. Cl. ..... 473/266; 473/207; 473/272

(58) Field of Classification Search ..... 473/207, 473/218, 219, 227, 257, 258, 261, 266, 268, 473/270, 271–273, 277
See application file for complete search history.

(56) References Cited

U.S. PATENT DOCUMENTS

| | | | |
|---|---|---|---|
| 3,623,733 | A | 11/1971 | Cavenaugh |
| 4,659,084 | A | 4/1987 | Vuick |
| 4,758,001 | A | 7/1988 | Otting et al. |
| 4,993,716 | A | 2/1991 | Waller |
| 5,255,921 | A | 10/1993 | Spence |
| 5,456,470 | A | 10/1995 | Scheurer |
| 5,591,090 | A | 1/1997 | Kauffman, Jr. |
| 5,616,085 | A | 4/1997 | LaCoste, Jr. et al. |
| 5,707,300 | A | 1/1998 | May et al. |
| 5,762,565 | A | 6/1998 | Milam et al. |
| 5,769,732 | A | 6/1998 | O'Neal |
| 5,830,079 | A | 11/1998 | Hudson |
| 6,024,656 | A | 2/2000 | Lane |
| 6,174,270 | B1 | 1/2001 | Dagenais |
| 6,497,627 | B2 | 12/2002 | Collins |
| 6,551,196 | B1 | 4/2003 | Kossnar et al. |
| 6,575,844 | B1 | 6/2003 | Gray |
| 6,843,730 | B1 | 1/2005 | Bellagamba |
| 6,988,957 | B2 | 1/2006 | Bender |
| 7,066,828 | B2 | 6/2006 | Lee et al. |
| 7,150,683 | B2 | 12/2006 | Bender |
| D574,916 | S | 8/2008 | Ford |
| 7,708,650 | B2 | 5/2010 | Lloyd |
| 7,758,443 | B1 | 7/2010 | Ford |

*Primary Examiner* — Nini Legesse
(74) *Attorney, Agent, or Firm* — John P. McGonagle

(57) ABSTRACT

A golf work station having a base module with telescoping knee guides and adjustable target knee posts. A rear attachment module having a posture post is removably attached to the base module rear, said posture post being longitudinally extensible and angularly adjustable. A swing attachment module having an adjustable swing plane ring is pivotally and removably attached to the base module and rear attachment modules.

6 Claims, 5 Drawing Sheets

GOLF WORK STATION

CROSS-REFERENCE TO RELATED APPLICATIONS

This application is a continuation-in-part of U.S. patent application Ser. No. 12/321,206, filed Jan. 16, 2009 now U.S. Pat. No. 7,758,443.

BACKGROUND OF THE INVENTION

This invention relates to a golf training apparatus, and in particular, to an apparatus for aligning a golfer's body for all aspects of a golf club swing, including drivers, fairway woods, utility clubs, irons and putters.

Golf is an addictive sport and can be very frustrating. It is a sport which relies primarily on technique for effective play. Techniques required for all of the shots required in golf, i.e., driving a ball, fairway wood shots, iron play and putting, have many common elements but also some different elements. For example, the position of the golfer's body with respect to the golf ball, the position of the golfer's body itself, i.e., stance, the take away of the golf club and follow through when striking the golf ball, all have similarities and variables for each shot. Although the various techniques may be learned, muscle and mind memory for the various techniques will vary depending upon a golfer's condition, lapsed time, or many of life's living challenges faced by all golfers.

The prior art is full of a wide variety of training devices for golfers. Each of the devices focuses on one or a few of the technique aspects required for a golf swing. Most of the devices focus on teaching new techniques. Few, if any, focus on refreshing memory of a previously learned technique. For most golfers, access to a wide variety of training devices is just impractical.

Golf professionals may have a few training devices to help instruction. However, there is an expense involved, both for the devices themselves but also in time lost setting up each training device for instruction.

What is required is a global training apparatus which provides means for teaching and reviewing all of the techniques used in playing golf, including driving a ball, fairway wood shots, iron play and putting.

SUMMARY OF THE INVENTION

The present invention addresses the above problems by providing a golf work station which provides comprehensive teaching and review of the techniques required for making golf shots. The workstation teaches lower body stability encouraging proper balance, level hip rotation and delivering the golf club with effortless power. The workstation helps identify improper golfing movements such as sway, lunge, stand up, "come out of the shot", loss of balance, the "over the top", "the slide" and "duck under" moves. The present invention establishes correct pattern movement which helps groove a golf swing. The present invention helps improve a golfer's swing plane by teaching turns in balance, maintaining posture, rotation of shoulders and arms with connection and extension. The workstation assists in teaching proper footwork and clearing of the hip move. The present invention provides the means to teach new techniques and review old techniques.

The present invention accomplishes the above objects by providing a golf work station having a base module with telescoping knee guides and adjustable target knee posts. A rear attachment module having a posture post is removably attached to the base module rear, said posture post being longitudinally extensible and angularly adjustable. A swing attachment module having an adjustable swing plane ring is pivotally and removably attached to the base module and rear attachment module.

The present invention golf work station is a continuation-in-part of applicant's previously filed application Ser. No. 12/321,206, now U.S. Pat. No. 7,758,443 ('443 patent), and comprises improvements of the originally disclosed golf work station as well as the addition of a swing attachment module, said '443 patent being incorporated herein by reference.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
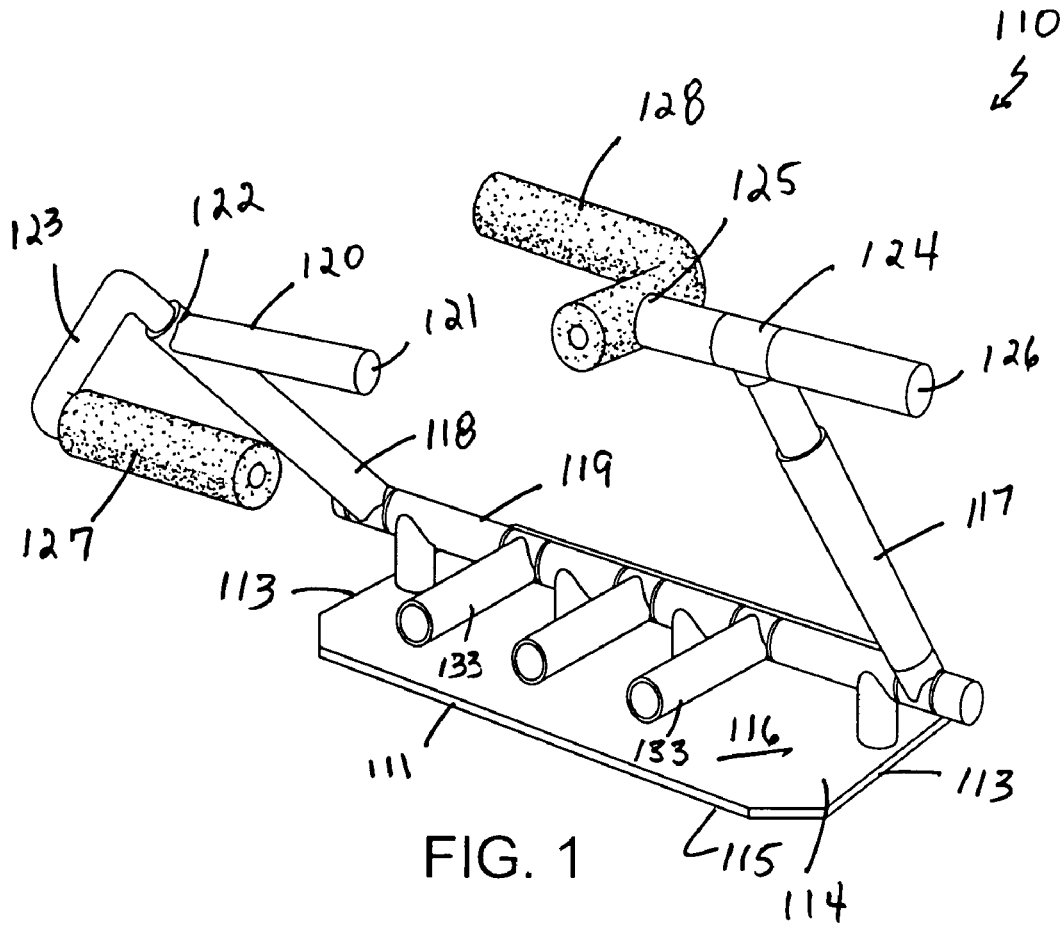
FIG. 1 is a front perspective view of the base module.

Referring to the drawings in detail wherein like elements are indicated by like numerals, there is shown a golf work station 101 comprised of a base module 110, a rear attachment module 130 attached to the base module, and a swing attachment module 190 pivotally and removably attached to the rear attachment module 130.

The base module 110 has a front 111, rear 112, and two opposite sides 113, said base module front 111 and rear 112 defining a work station central axis, said base module opposite sides 113 defining a base module transverse axis. The base module 110 is comprised of a base plate 114 having a bottom surface 115 and a top surface 116. The base plate 114 may have a generally rectangular shape and may be made from a marine grade PVC. The base plate bottom surface 115 is adapted to rest on an indoor floor or outdoor surface such as a mat or ground. The base plate bottom surface 115 may have means to prevent slippage. The base module 110 is further comprised of two telescoping knee guides, a left knee guide 117 and a right knee guide 118, pivotally extending from a base bar 119 fixedly attached to the base plate top surface 116, said base bar 119 having a longitudinal axis parallel to the base module transverse axis.

The right knee guide 118 terminates in an elongated pivot element 120, said pivot element having a longitudinal axis parallel to the base module transverse axis. The pivot element 120 has an inside end 121 and an outside end 122, said outside end terminating in a forwardly extending protrusion 123, said forwardly extending protrusion 123 terminating in an elongated angled element 127 with a longitudinal axis parallel to the pivot element longitudinal axis. The forwardly extending protrusion 123 may be pivotally attached to the pivot element outside end 122. The elongated angled element 127 is preferably encased in an expanded plastic tube made from polystyrene and sold under the trademark, STYROFOAM. The left knee guide 117, which may be telescopic, terminates in an adjustable target knee rod 124 with an inside end 125 and an outside end 126, said inside and outside ends defining a target knee rod longitudinal axis, said target knee rod longitudinal axis being parallel to the base module transverse axis. The target knee rod inside end 125 terminates in an "L" shaped element 128, said L-shaped element 128 preferably being encased in a STYROFOAM sleeve.

For purposes of exposition, it has been assumed that the golfer using the work station 101 is right handed. The work station 101 may be easily adapted for a left handed golfer by reversing the work station elements. In operation, the golfer 102 stands at the base module front 111 forward of a base plate front edge 129. The right knee guide pivot element 120 is adapted to fit behind the right knee of a golfer 102 and the angled element forward of the golfer's right knee, with the pivot element forwarding extending protrusion 123 positioned just to the outside of the golfer's right knee. The left knee guide target knee rod inside end 125 is positioned against the outside of the golfer's left knee with the L-shaped element 128 behind the golfer's left knee. The training purpose of the base module 110 is primarily to eliminate "sway" in a golfer's swing. The right knee guide pivot element 120 keeps the golfer from "pulling up" and/or swaying rightward during golf club take away. The left knee guide target knee rod inside end 25 and L-shaped element 28 place pressure against the outside and back of the golfer's left knee thereby halting leftward sway as the golfer strikes through the golf ball. See FIG. 1.

The rear attachment module 130 is attached to the base module 110. The base module base bar 119 has two receivers 133 pivotally attached thereto. A generally rectangular posture frame 131 having a bottom 132 and top 134 is inserted into the two receivers 133, posture frame bottom 132 first. A posture module 135 is attached to the posture frame top 134. The posture module 135 has an elongated horizontal bar 136 attached thereto and positioned forward of the posture frame 131. The horizontal bar 136 has a longitudinal axis parallel to the base bar longitudinal axis. The posture module 135 is further comprised of an upright, elongated, posture bar 137 having a longitudinal axis transverse to the longitudinal axis of the horizontal bar 136. The posture bar 137 is adapted to receive an elongated foam posture rest 138. The foam posture rest 138 may be an expanded plastic tube made from polystyrene and sold under the trademark, STYROFOAM.

Figure 2:
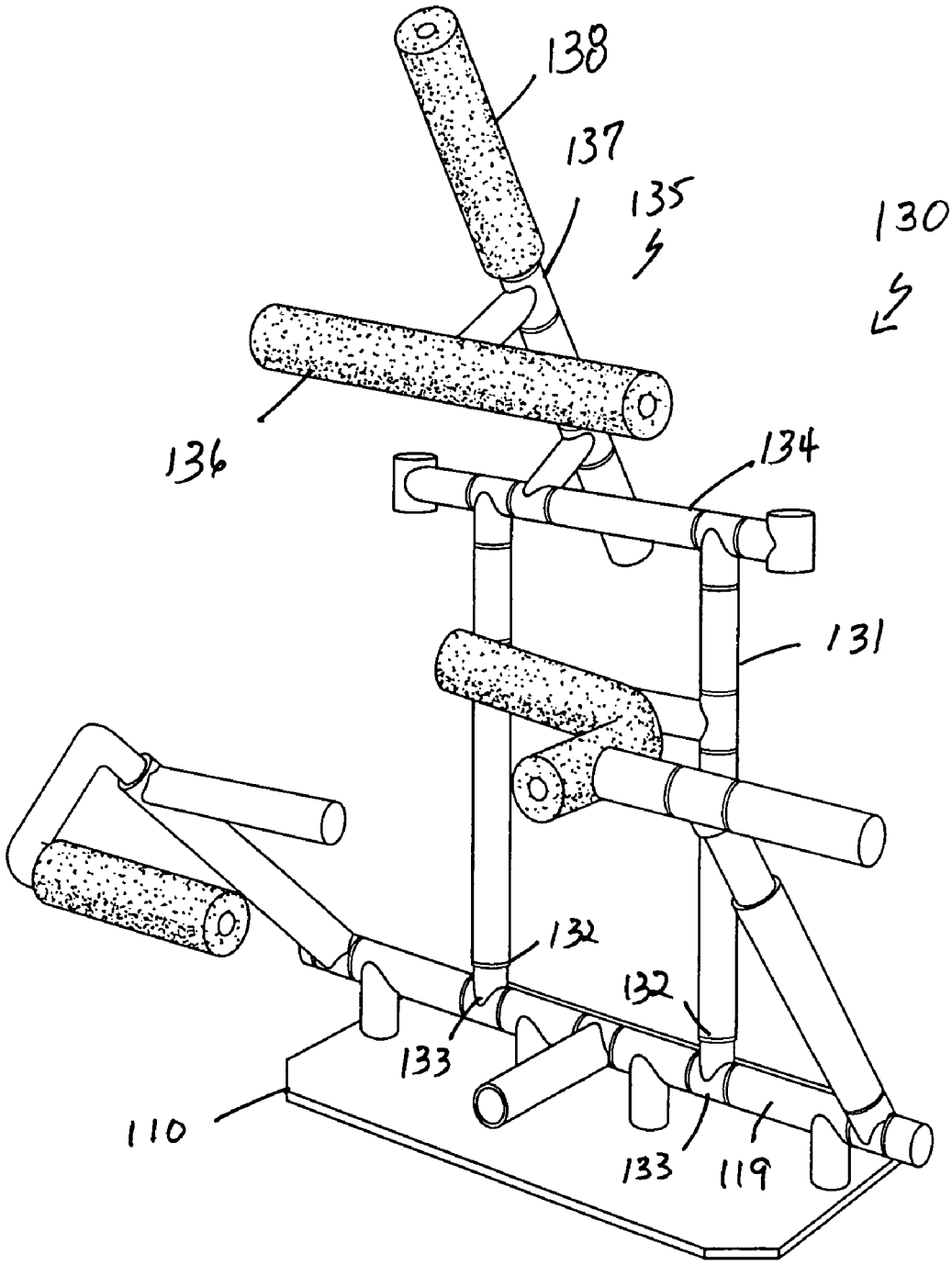
FIG. 2 is a front view of the rear attachment module.

In operation, the rear attachment module 130 is designed to assist the golfer in maintaining a proper posture and body bend during the golf swing. The posture bar 137 and rest 138 is forwardly pivoted to a desire angle, which would correspond to the desired body angle bend for a particular golfer. The horizontal bar 136 assists the golfer in holding a desired pelvic position. In combination with the base module 110, the posture module 135 provides a more complete guide for a golfer's stance and body during the golf swing. See FIG. 2.

The rear attachment module 130 is further comprised of a generally upright device 170 providing means for alignment of a golfer's shoulders and for control of the golfer's swing during the golfer's back swing. The upright device 170 is comprised of a first element 171 vertically attached to the right side of the posture frame top 134. The first element top 172 terminates in a first adjustable knuckle 173 joined to an upright device second element 174. The second element 174 is angled in a vertical plane and is positioned so that the second element top 175 is tilted in a forward direction. The second element top 175 also terminates in a second adjustable knuckle 176 joined to an upright device third element 177. The third element 177 is angled in a vertical plane and is positioned so that the third element top 178 is tilted in a forward direction. The third element top 178 terminates in a second "L-shaped" element 180, specifically at the junction of two legs 181, 182. The second L-shaped element 180 is comprised of a forwardly and downwardly extending leg 181 coupled to a laterally extending leg 182. See FIG. 3.

In operation, the golfer aligns his shoulder plane/angle at the top of his back swing with the forwardly and downwardly extending leg 181. The golf club at the top of the back swing is positioned beneath the laterally extending leg 182 thereby preventing the club from going "over the top" at the golfer's downward swing movement from the top of the back swing.

Figure 4:
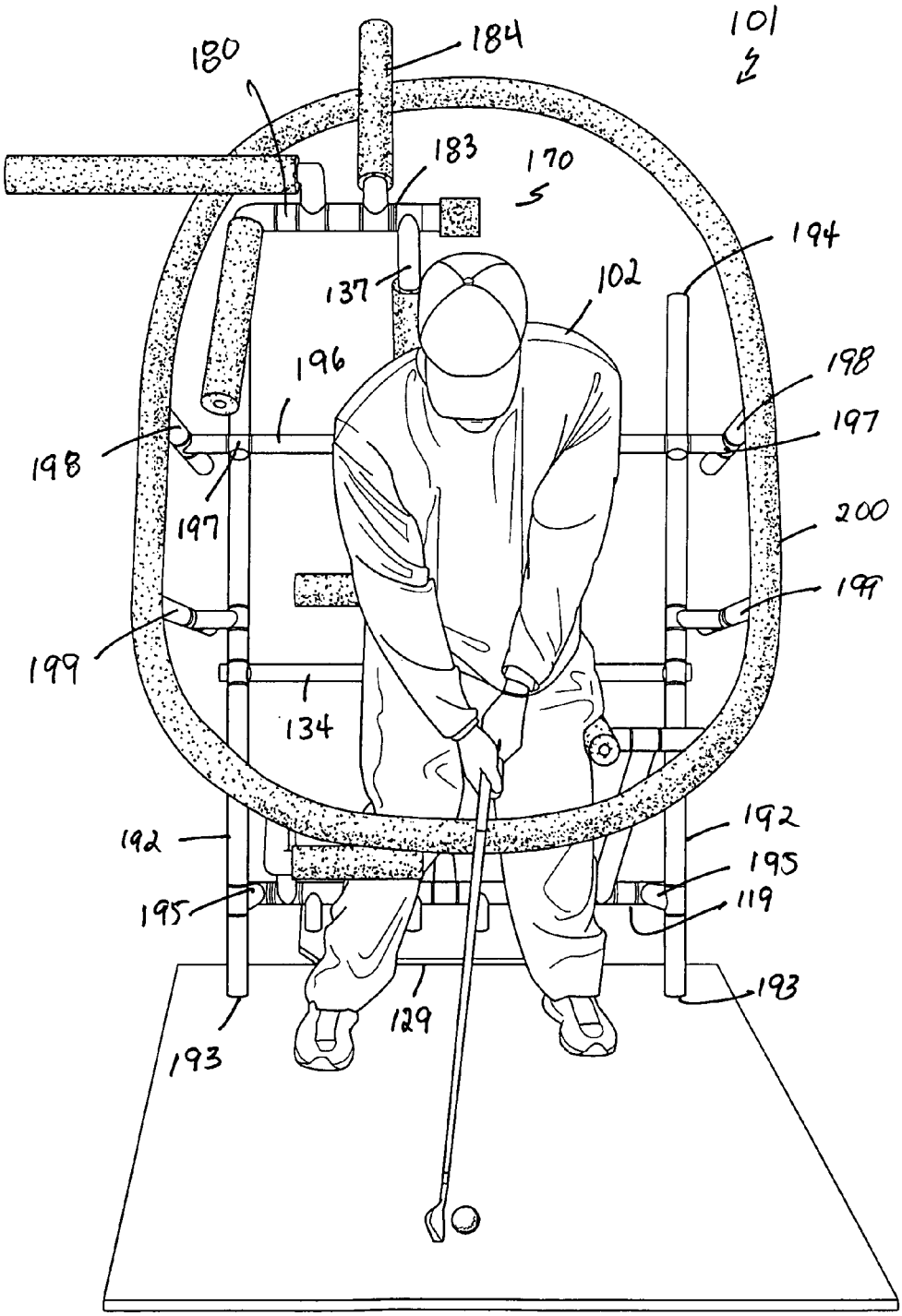
FIG. 4 is a front view of a swing attachment module having an adjustable swing plane ring attached to the rear attachment module with an attached swing guide.
Figure 5:
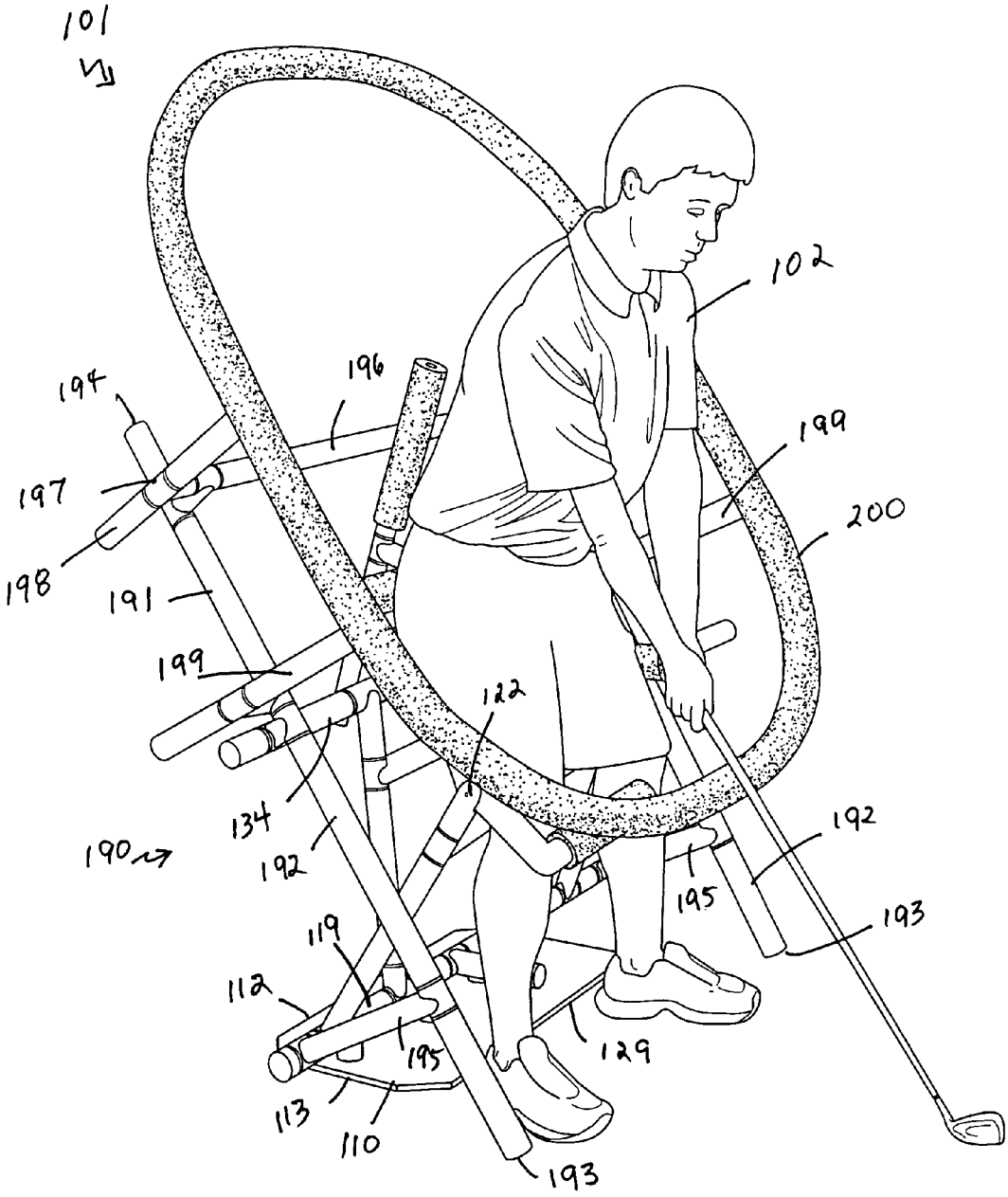
FIG. 5 is a front perspective view of a swing attachment module having an adjustable swing plane ring attached to the rear attachment module.

Referring more particularly to FIGS. 4 and 5, the golf work station 101 is further comprised of a swing attachment module 190. FIG. 4 illustrates the swing attachment module 190 used in conjunction with the rear attachment module 130 and the upright device 170. FIG. 5 illustrates the swing attachment module 190 used in conjunction with the rear attachment module 130 without the upright device 170. The swing attachment module 190 is comprised of a swing frame 191 having an adjustable swing plane ring 200 said swing frame 191 being attached to the base module 110 and rear attachment module 130.

The swing frame 191 is comprised of two opposite and parallel, elongated support posts 192 each having a bottom end 193 and a top end 194, said bottom and top ends defining a support post longitudinal axis. Each support post bottom end 193 is positioned outside the base module sides 113 forward of the base plate front edge 129. Each support post top end 194 is positioned outside the base module sides 113 rearward of the base module rear 112. A support strut 195 is attached to each end of the base module base bar 119. Each support strut 195 interconnects the base bar 119 with a support post 192. The rear attachment module posture frame top 134 is extended on each end and joined on each end to a support post 192. An elongated cross bar 196 interconnects each support post 192 at a point near to the support post top end 194. A pivotal brace 197 is connected at the junction of each support post 192 with the cross bar 196. An elongated element 198 is attached to each pivotal brace 197, said elongated element having a longitudinal axis transverse to the longitudinal axis of the connected support post 192. An elongated brace element 199 is attached to each support post 192 adjacent to the posture frame top 134.

Figure 3:
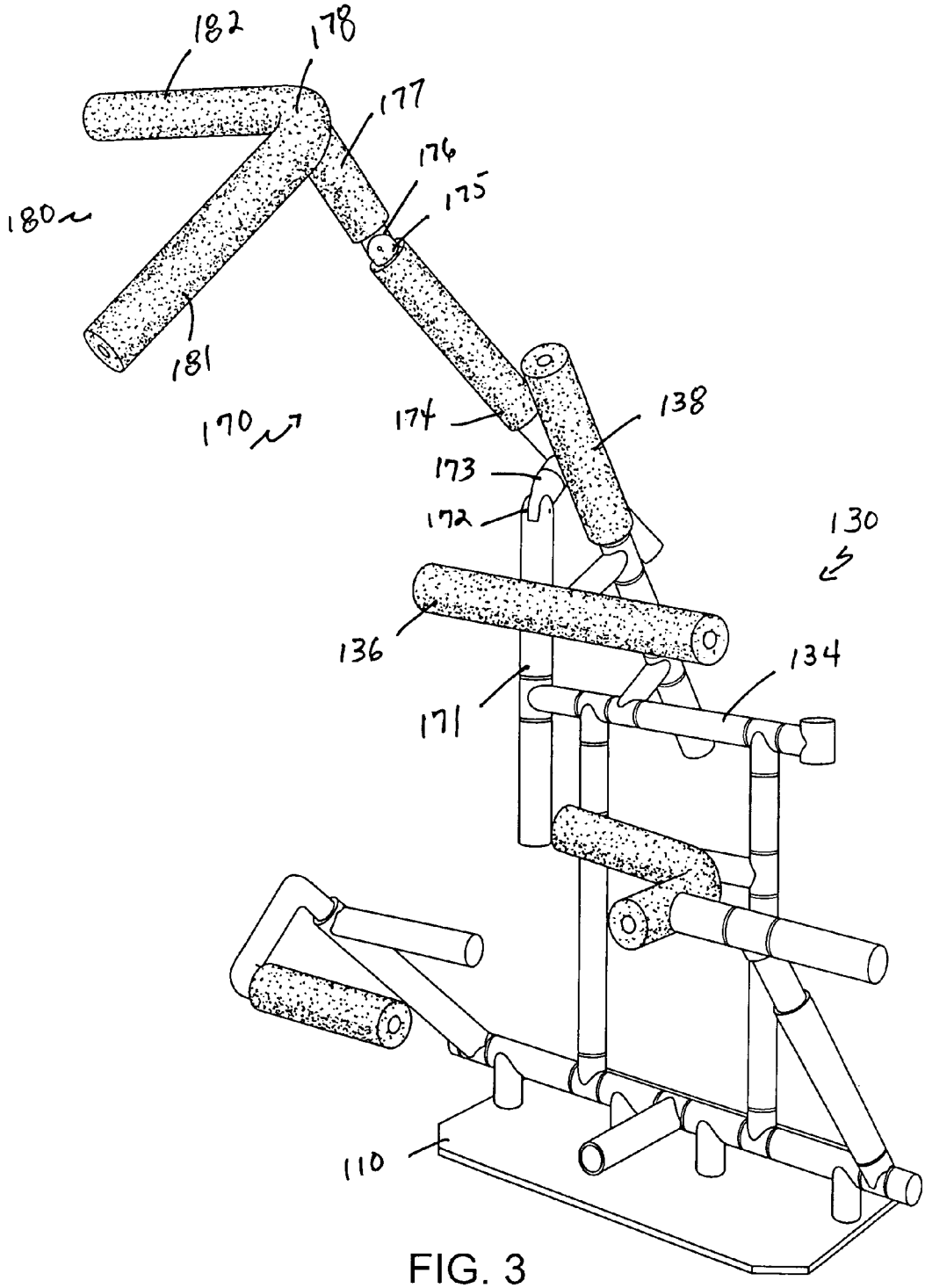
FIG. 3 is a front perspective view of the rear attachment module with an attached swing guide.

The swing plane ring 200 is attached to the two elongated elements 198. The swing plane ring 200 rests on the two brace elements 199 when fully deployed. The swing plane ring 200 provides a golfer with a desired swing plane through a fully golf club swing. See FIG. 5.

Where the swing attachment module 190 is used in conjunction with the rear attachment module 130 and the upright device 170 as shown in FIG. 4, the upright device 170 is modified. The first element 171 as shown in FIG. 3 is eliminated. A lateral element 183 is attached to the top of the posture bar 137. The lateral element 183 projects to the right of a golfer and terminates in the second L-shaped element 180. The swing plane ring 200 is adapted to being positioned beneath the second L-shaped element 180. During the golfer's back swing the golf club lies in a gap between the swing plane ring 200 and the second L-shaped element 180. To provide further guidance during the back swing, an elongated positioning bar 184 may be attached to the lateral element 183, said positioning bar extending upwardly and rearwardly and having a longitudinal axis generally parallel to the longitudinal axis of the forwardly and downwardly extending leg 181. The gap between the positioning bar 184 and the swing plane ring 200 provides a complete swing plane for the golfer's back swing.

When use of the swing plane ring 100 is not desired, the swing plane ring is simply lifted up off of the brace elements 199 and pivoted backward about the pivotal braces 197 to the rear of the golf work station.

It is understood that the above-described embodiment is merely illustrative of the application. Other embodiments may be readily devised by those skilled in the art which will embody the principles of the invention and fall within the spirit and scope thereof.

I claim:

1. A golf work station for teaching and reviewing techniques used in playing golf, comprising:

a base module having a front, rear, and two opposite sides, said base module front and rear defining a work station central axis, said base module opposite sides defining a base module transverse axis, comprising:

a base plate having a bottom surface and a top surface, said base plate bottom surface adapted to rest on an indoor floor or outdoor surface such as a mat or ground;

a base bar fixedly attached to the base plate top surface, said base bar having a longitudinal axis parallel to the base module transverse axis;

two telescoping knee guides, a left knee guide and a right knee guide, each pivotally extending from said base bar, wherein:

the right knee guide terminates in an elongated pivot element, said right knee guide pivot element having a longitudinal axis parallel to the base module transverse axis, said right knee guide pivot element having an inside end and an outside end, said right knee guide pivot element outside end terminating in a forwarding extending protrusion, said forwardly extending protrusion terminating in an elongated angled element with a longitudinal axis parallel to the pivot element longitudinal axis;

the left knee guide terminates in an adjustable target knee rod with an inside end and an outside end, said knee rod inside and outside ends defining a target knee rod longitudinal axis, said target knee rod longitudinal axis being parallel to the base module transverse axis, said target knee rod inside end terminating in an L-shaped element.

2. A golf work station as recited in claim 1, further comprising a rear attachment module removably attached to the base module, comprising:

two receivers pivotally attached to said base module base bar;

a generally rectangular posture frame having a bottom and a top, said posture frame bottom being inserted into the two receivers;

a posture module attached to the posture frame top, said posture module having an elongated horizontal bar attached thereto and positioned forward of the posture frame, said horizontal bar having a longitudinal axis parallel to the base bar longitudinal axis, said posture module also having an upright, elongated, posture bar having a longitudinal axis transverse to the longitudinal axis of the horizontal bar.

3. A golf work station as recited in claim 2, wherein said rear attachment module is further comprised of:

a generally upright device providing means for alignment of a golfer's shoulders and for control of the golfer's swing during the golfer's back swing, said upright device comprising:

a first element vertically attached to a right side of the posture frame top, said first element top terminating in a first adjustable knuckle joined to an upright device second element;

said second element angled in a vertical plane and positioned so that a second element top is tilted in a forward direction, said second element top terminating in a second adjustable knuckle joined to an upright device third element;

said third element angled in a vertical plane and positioned so that a third element top is tilted in a forward direction, said third element top terminating in a second "L-shaped" element, specifically at the junction of two L-shaped element legs;

said L-shaped element comprised of a forwardly and downwardly extending leg coupled to a laterally extending leg.

4. A golf work station as recited in claim 2, further comprising a swing attachment module comprising:

a swing frame attached to the base module and rear attachment module and comprising:

two opposite and parallel, elongated support posts each having a bottom end and a top end, said bottom and top ends defining a support post longitudinal axis, each said support post bottom end positioned outside the base module sides forward of the base plate front edge, each said support post top end positioned outside the base module sides rearward of the base module rear;

a support strut attached to each end of the base module base bar, each said support strut interconnecting the base bar with a support post;

wherein the rear attachment module posture frame top is extended on each end and joined on each end to a support post;

an elongated cross bar interconnecting each support post at a point near to the support post top ends;

a pivotal brace connected at the junction of each support post with the cross bar;

an elongated element attached to each pivotal brace, each said elongated element having a longitudinal axis transverse to the longitudinal axis of the connected support post;

an elongated brace element attached to each support post adjacent to the posture frame top; and a swing plane ring attached to the two elongated elements, said swing plane ring adapted to rest on the two brace elements.

5. A golf work station as recited in claim 4, wherein said rear attachment module is further comprised of:

a lateral element attached to the top of the posture bar, projecting to the right of a golfer and terminating in a second L-shaped element, said L-shaped element comprised of a forwardly and downwardly extending leg coupled to a laterally extending leg;

an elongated positioning bar attached to the lateral element, said positioning bar extending upwardly and rearwardly and having a longitudinal axis generally parallel to the longitudinal axis of the forwardly and downwardly extending leg;

wherein the swing plane ring is positioned beneath the second L-shaped element.

6. A golf work station as recited in claim 5, wherein:

the elongated angled element is encased in an expanded plastic tube made from polystyrene;

the L-shaped element is encased in an expanded plastic tube made from polystyrene;

the posture bar is adapted to receive an elongated foam posture rest made of an expanded plastic tube made from polystyrene.

* * * * *